US008468728B2

(12) United States Patent
Nabors, Jr.

(10) Patent No.: US 8,468,728 B2
(45) Date of Patent: Jun. 25, 2013

(54) BREAKAWAY OUTDOOR SIGNS

(76) Inventor: Robert L. Nabors, Jr., Wilmington, NC (US)

( * ) Notice: Subject to any disclaimer, the term of this patent is extended or adjusted under 35 U.S.C. 154(b) by 0 days.

(21) Appl. No.: 13/373,083

(22) Filed: Nov. 3, 2011

(65) Prior Publication Data

US 2012/0186118 A1 Jul. 26, 2012

Related U.S. Application Data

(60) Provisional application No. 61/461,840, filed on Jan. 24, 2011.

(51) Int. Cl.
*G09F 7/00* (2006.01)

(52) U.S. Cl.
USPC ..... 40/607.01; 40/606.15; 40/602

(58) Field of Classification Search
USPC ..... 40/602, 606.15, 607.01, 612, 613
See application file for complete search history.

(56) References Cited

U.S. PATENT DOCUMENTS

| | | | | | |
|---|---|---|---|---|---|
| 692,841 | A | * | 2/1902 | Fenton | 40/607.13 |
| 1,449,063 | A | | 3/1923 | Shotwell | |
| 1,823,404 | A | | 9/1931 | Marx et al. | |
| 1,889,910 | A | | 12/1932 | Weamer | |
| 2,084,818 | A | | 6/1937 | Nell | |
| 2,800,734 | A | * | 7/1957 | Blackburn | 40/602 |
| 3,140,119 | A | * | 7/1964 | Offner | 297/411.3 |
| 3,521,390 | A | | 7/1970 | Carlson | |
| 4,503,631 | A | | 3/1985 | Kelly | |
| 5,613,314 | A | | 3/1997 | Leverenz et al. | |
| 6,004,002 | A | * | 12/1999 | Giannone | 362/183 |
| 6,467,208 | B1 | * | 10/2002 | Patterson | 40/570 |
| 2008/0028652 | A1 | * | 2/2008 | Makhija et al. | 40/606.15 |
| 2009/0183405 | A1 | * | 7/2009 | Wilkes | 40/543 |
| 2010/0018098 | A1 | | 1/2010 | Xu | |

* cited by examiner

*Primary Examiner* — Joanne Silbermann
*Assistant Examiner* — Christopher e Veraa
(74) *Attorney, Agent, or Firm* — MacCord Mason PLLC

(57) ABSTRACT

An outdoor sign resistant to wind damage includes a support column; a display having secured and released positions, a lower edge and a central vertical axis aligned with the axis of the column when the sign is in the secured position; a lower horizontal arm with opposed ends mounted on the upper end of the support column; an upper horizontal arm with opposed ends attached to the display, the upper arm being parallel to the display lower edge and the lower support arm when the display is in the secured position; a pivot mechanism joining the support arms adjacent one end; and a retainer mechanism between the opposite ends of the support arms, the mechanism releasibly securing the support arms to each other when the sign is in the secured position. The retainer mechanism is unlatched when the wind force is greater than a predetermined value.

17 Claims, 3 Drawing Sheets

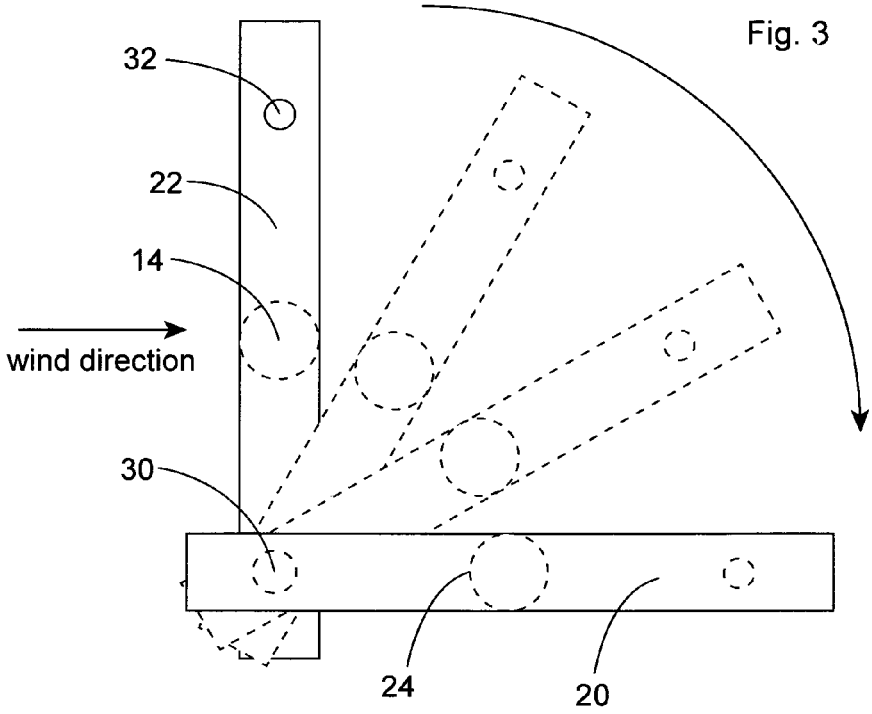
Fig. 3
Fig. 4
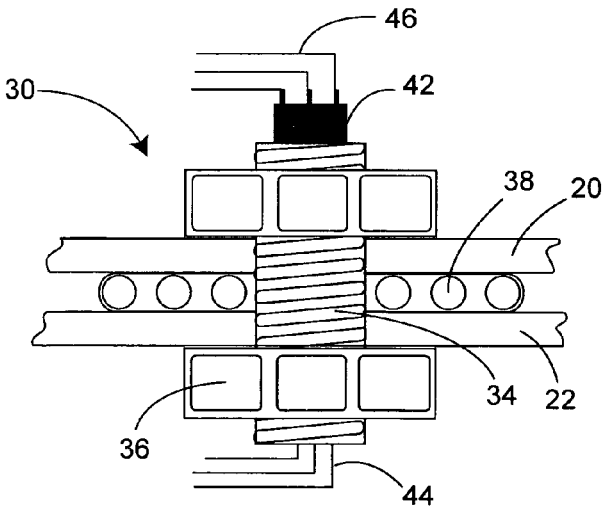
Fig. 5
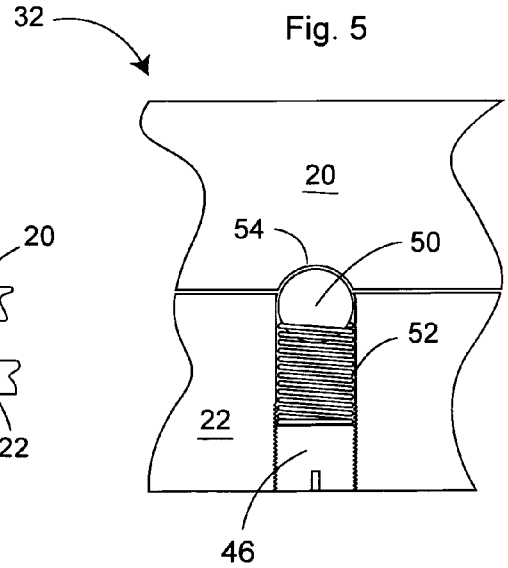

BREAKAWAY OUTDOOR SIGNS

This application claims the benefit of the filing date of U.S. Provisional Application No. 61/461,840, filed Jan. 24, 2011, which is incorporated herein by reference in its entirety.

BACKGROUND OF THE INVENTION (1) Field of the Invention

The present invention relates to outdoor advertising signs, and in particular to signs including means for permitting rotation of the sign advertising display about a vertical axis when the wind force exceeds a predetermined value.

(2) Description of the Prior Art

Large outdoor advertising signs, also known as billboards, are comprised of an upper rectangular advertising display assembly, or simply display, supported on and elevated for viewing on a support pole or column. The advertising display may be constructed in different ways, but generally includes a frame having parallel upper and lower edges, and parallel side edges. The frame surrounds a rectangular panel for placement of advertisements. In most signs, the frame will surround two spaced panels with one or both panels carrying advertising messages, such as the name of a business. The panels are normally parallel translucent panels that are spaced from each other, with an illumination source, such as a lighting fixture being positioned between the panels to back light the panels. The illumination source is connected via wiring to an external source of electricity.

The support column is comprised of a generally cylindrical vertical column having an upper end upon which the advertising display is mounted. Sign columns are now often constructed of steel, permitting the support of larger advertising displays at greater heights above the ground.

Signs are subject to wind damage, particularly in hurricane prone areas, due to the large surface area presented by the advertising display when the display is transverse to the wind direction, either at the front or back of the display. High winds can cause severe damage to advertising displays, and even to the support structures, as well as to persons or property in the vicinity of the sign if a part of the sign is separated from the structure. Such damage requires costly replacement and repair. Construction of signs to withstand greater wind forces also results in additional cost.

Various attempts have been made in the prior art to avoid damage to signs by constructing the signs with pivotal advertising displays that rotate to present a reduced surface to the wind direction when a wind force exceeding a predetermined value, e.g., 60 mph, is experienced. Generally, these prior art signs include a pivotal support for the advertising display and a pin that holds the display in place until the wind force exceeded the predetermined value. When there is excess wind force against the display, the pin is designed to shear off or displace from a detent, allowing the display to rotate about a pivot point so that the display face is parallel to the wind direction, i.e., so that an edge of the display is toward the wind direction, thereby presenting a smaller surface to wind impact and reducing the likelihood of damage.

While sign constructions described in the prior art may have been of some value in diminishing damage to signs as historically constructed, they are of little value in preventing damage to modern signs. Therefore, there is a continuing need for a sign, particularly an electrically illuminated sign, meeting the demands of modern sign construction that will withstand damage from high winds, e.g., winds exceeding 60 mph.

SUMMARY OF THE INVENTION

Generally, the present invention relates to outdoor advertising signs, also known as signs, of the type found along highways and at commercial facilities, in which the advertising display carrying the advertising message is mounted on top of a vertical column, with the central vertical axis of the rectangular advertising display being aligned with the longitudinal axis of the support column.

More particularly, the present invention relates to a sign of this type which includes a display support mounted on the top of the support column to permit pivotal movement of the advertising display when the display is subjected to wind forces exceeding a predetermined value. When the display includes an illumination source with wiring extending through the support column to the display, the present invention allows rotation of the display without damage to or disconnection of the wiring.

More specifically, the present sign, also referred to herein as a billboard, is comprised of an advertising display that is mounted using an unique support mechanism onto a vertical support column so that the display can pivot when subjected to a wind of greater than a predetermined force without damage to the display or any electrical connection.

The advertising display may be of different constructions, but generally includes a rectangular frame having a lower edge for attachment to the display support mechanism and spaced, parallel panels mounted within the frame for the display of advertising messages. The panels are normally translucent with an illumination source being mounted between the panels for backlighting of the panels so that the advertisements can be seen at night.

The vertical support column includes an upper end to which the display support mechanism is attached. The column may have a uniform cross section, which may be cylindrical, hexagonal, octagonal, etc. The column may be upwardly tapered so that the upper end of the column is smaller than the lower end of the column. The column will normally be constructed of metal, e.g., steel, or of fiberglass.

The display support mechanism is comprised to an upper horizontal support arm having an upper surface attachable to the lower surface of the advertising display frame, and a lower horizontal support arm having a lower surface attached to the upper end of the column, e.g., by a centrally positioned sleeve attachable around the upper end of the column. The upper and lower arms are aligned when the advertising display is in its non-displaced position with the ends of the upper arm being above the ends of the lower arm.

The support arms are joined adjacent one end by a vertical pivot mechanism which is laterally offset to one side of the central axis of the advertising display and the column. The pivot mechanism is comprised of a threaded cylindrical pivot shaft. The upper end of the pivot shaft is joined to the upper support arm, while the lower end of the pivot shaft is joined to the lower support arm. The shaft is designed to be rotatable relative to at least one of the support arms so that the upper support arm and display can rotate about the pivot shaft relative to the lower support arm and the support column.

The pivot shaft is secured to the upper and lower arms by nuts threaded onto the ends of the shaft. A ball bearing ring surrounds the pivot shaft and abuts the facing surfaces of the upper and lower arms to impart ease of rotation and also to prevent up and down motion of the distal end of the upper arm.

A retractable retention mechanism is mounted between the support arms adjacent the ends of the support arms opposite the pivot mechanism. The retention mechanism includes a retractable retainer mounted on one of the arms and urged toward the other arm by a spring, which is adjustable in tension. The opposed arm includes a recess to receive the projection. For example, the retainer can be a spherical locking ball that is urged into a hemispherical recess in the opposed arm by a compressed spring having an outer end pressed against the ball and an inner end that is moveable up or down by an adjustable screw.

Generally, the retention mechanism is offset from the vertical central axis of the column/display by a distance approximately equal to the offset of the pivot shaft on the opposite side of the central axis. The mechanism is also preferably designed so that the pivot shaft, central axis and retainer projection lie in a common vertical plane.

If the display is illuminated, the pivot mechanism also includes an electrical swivel connector within the pivot shaft. The electrical swivel includes an upper section with upper wiring connections and a lower section with lower wiring connections. The upper and lower sections are electrically connected via slip rings allowing 360° rotation of the sections relative to each other while maintaining electrical contact. Electrical wiring from an exterior power source extends upwardly through the column to connect to the lower section, while display wiring extends from the upper section to the illumination source.

In operation, the sleeve of the lower support arm is attached to the top of the column to secure the support arm on top of the column, with the advertising display being secured to the top of the upper support arm. The display is aligned so that the support arm is parallel to the face of the advertising display and the display panel or panels face the area from which the advertisement is to be viewed. The upper and lower arms are pivotally secured to each other adjacent one end by the pivot mechanism. The retainer mechanism is mounted on one of the arms adjacent the other end of the arms with the retainer projecting into a recess in the opposed support arm.

When a wind force is experienced either on the front face or the rear face of the advertising display at speed that is in excess of the preset value, the torque against the advertising display forces the retainer against the force of the spring unseating the retainer from the recess, and allowing the advertising display to rotate freely about the vertical pivot shaft so that the advertising display swings away from the wind direction, orienting the face of the advertising display parallel to the wind direction with the side edge of the display closest to the pivot point being toward the wind. In this orientation the force against the display is minimized, thereby eliminating or greatly reducing the likelihood of damage to the sign.

After conditions return to normal, the advertising display is simply rotated back to its original position so that the retainer is again urged into the recess, thereby securing the display in its original operative position. Since the electrical connection to the display illumination source is not broken, use of the display can be resumed without repairs being necessitated.

BRIEF DESCRIPTION OF THE DRAWINGS

FIG. 3 is a top view of the sign illustrating rotation of the advertising display from the closed position to various unlocked positions.

FIG. 4 is a sectional side view of the pivot mechanism.

FIG. 5 is a sectional side view of the retention mechanism.

DETAILED DESCRIPTION OF THE INVENTION

Figure 1:
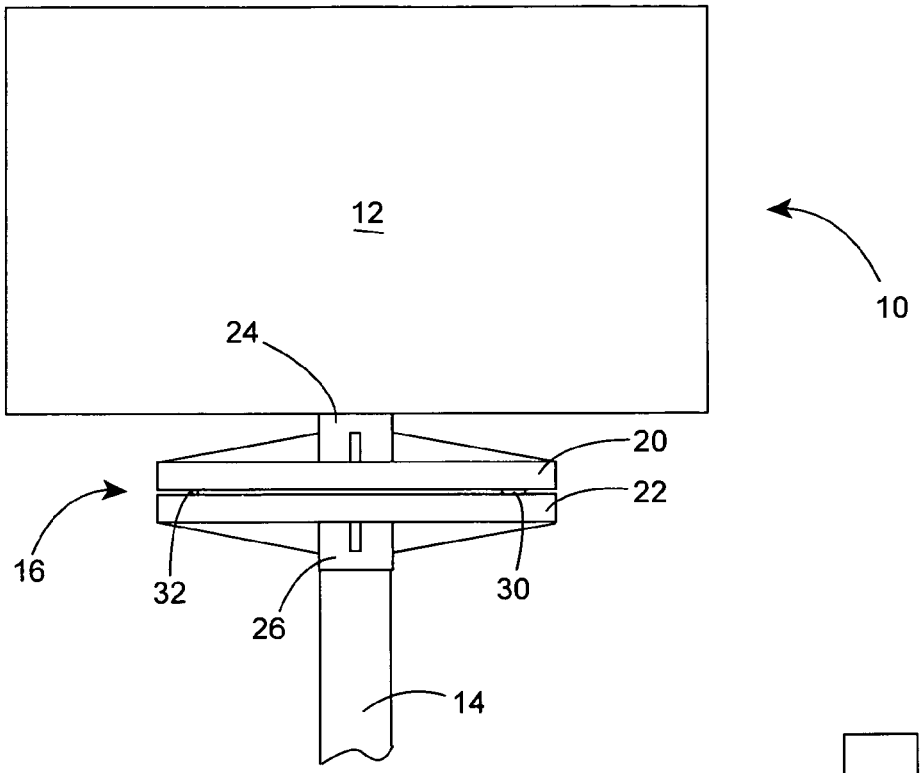
FIG. 1 is a front view of the breakaway sign in the closed position.
Figure 2:
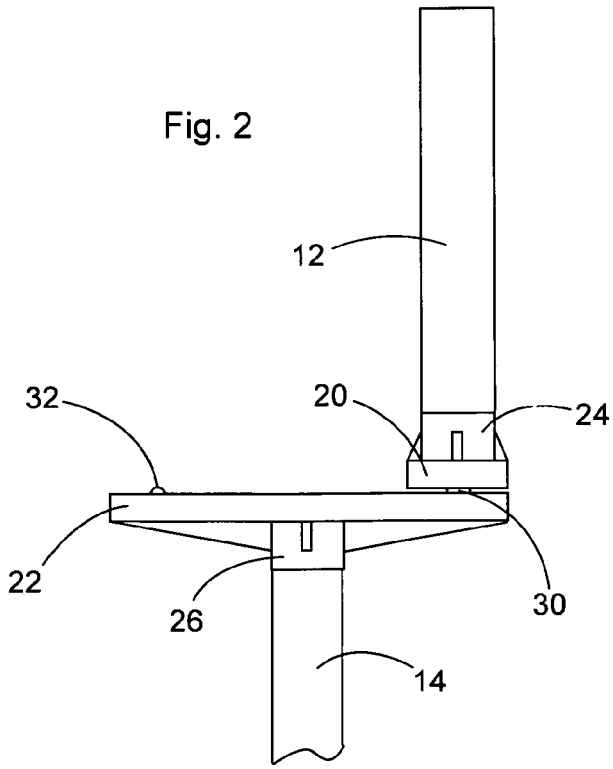
FIG. 2 is a front view of the sign with the retainer mechanism unlatched.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, a preferred embodiment of the breakaway sign, generally 10, is comprised of an advertising display 12, a vertical support pole or column 14, and a support mechanism 16. Support mechanism 16 is comprised of an upper support arm 20, a lower support arm 22. An upper sleeve 24 adapted for attachment to the bottom of display 12 projects upward from the top of upper support arm 20, while a lower sleeve 26 adapted for attachment to the top of column 14 projects downwardly from the bottom of lower support arm 22. Column 14, display 12 and sleeves 24 and 26 have a common vertical axis.

Pivot mechanism 30, illustrated in FIG. 4, is positioned between arms 20 and 22 adjacent one end of support mechanism 16, while retention mechanism 32 is positioned between arms 20 and 22 adjacent the other end of support mechanism 16. Pivot mechanism 30 is comprised of a tubular shaft 34 having threaded ends for attachment of locking nuts 36. Circular ball bearing ring 38 is positioned around shaft 34 between arms 20 and 22.

Figure 6:
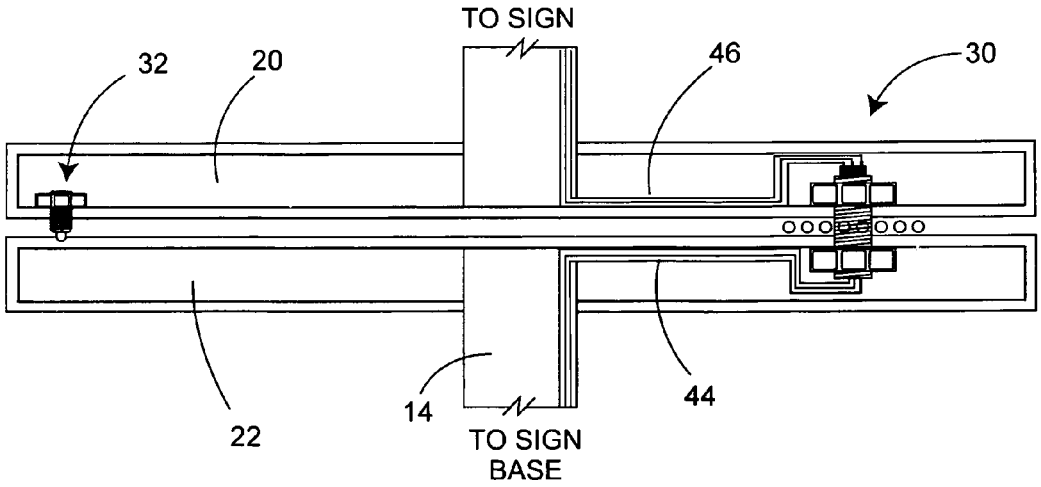
FIG. 6 is a sectional side view of the pivot mechanism and electrical wiring with some sections of the support mechanism being removed for clarity.
Figure 7:
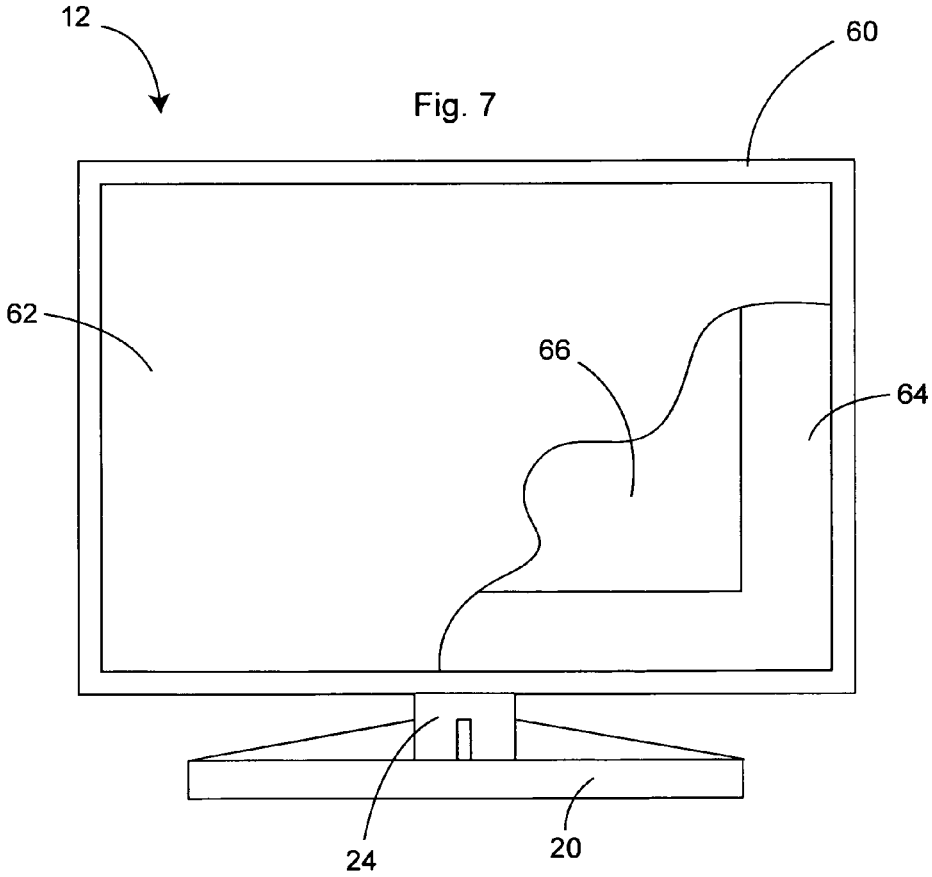
FIG. 7 is a front view of the advertising display.

Electrical swivel 42 is inserted inside shaft 34. As shown in FIGS. 4 and 6, wiring 44 extends upwardly thorough column 14 and then through the interior of arm 22 to connect the lower section of swivel 42 to a source of electricity, not shown, while wiring 46 extends from the upper section of swivel 42 through the interior of arm 20 and to illumination source 66 within display 12.

As best illustrated in FIG. 5, retention mechanism 32 is comprised of retainer, e.g., locking spherical ball 50, that extends upwardly from the upper surface of arm 22, with spring 52 urging ball 50 upwardly into a recess 54 in the lower surface of arm 20. Adjustment screw 56 is used to change the compression on spring 52, and thereby the force of spring 52 against ball 50, with the force required to unseat ball 50 from recess 54 increasing as the compression increases. It will be understood that the positions of the retention mechanism components can be reversed as illustrated in FIG. 6, i.e., ball 50 can project downwardly from the lower surface of upper arm 20 into a recess in the upper surface of lower arm 22.

When a wind force in excess of a preset value, e.g., 60 mph, is exerted against display 12, ball 50 is unseated from recess 54, allowing display 12 to pivot freely about the vertical axis of shaft 34 as shown in FIG. 3, resulting in alignment of the front face of display 12 parallel with the wind direction and the edge of display 12 closest to pivot mechanism 30 is toward the direction from which the wind is blowing. As a result, minimal force is exerted against display 12 avoiding or greatly reducing the likelihood of damage to sign 10.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An outdoor sign resistant to high wind damage comprising:

a) a vertical support column having an upper end and a vertical axis;

b) a display having a secured position and a released position, a lower edge and a central vertical axis aligned with the central vertical axis of said column when said sign is in the secured position;

c) a lower horizontal arm with opposed first and second ends mounted on the upper end of said support column, said lower arm including a first sleeve attaching said lower arm to said column;

d) an upper horizontal arm with first and second ends attached to said display, said upper arm being parallel to said display lower edge and aligned with said lower support arm when said display is in the secured position, said upper arm including a second sleeve attaching said upper arm to said display;

e) a pivot mechanism joining said support arms adjacent said first ends; and a retainer mechanism between the second ends of said support arms, said mechanism having a latched position releasibly securing the second ends of said support arms to each other when said sign is in the secured position, and an unlatched position, said retainer mechanism being moved to the unlatched position by a wind force greater than a predetermined value, allowing rotation of said display around said pivot mechanism to said released position.

2. The sign of claim 1, wherein said pivot mechanism is comprised of a vertical shaft attached to said upper and lower arms, at least one of said arms being rotatable relative to said shaft.

3. The sign of claim 1, wherein the second end of one of said arms includes a recess, and said retention mechanism is comprised of a retractable retainer mounted in the other of said arms, said retainer being forced from said recess when wind force against said display exceed a predetermined value.

4. The sign of claim 3, wherein said retractable retainer is a spherical ball, said retention mechanism including a spring urging said ball into said recess.

5. The sign of claim 1, wherein said sign is illuminated, said sign further including an illumination source in said display and electrical wiring extending to said illumination source through said column, said pivot mechanism and said arms.

6. The sign of claim 1, wherein said display is comprised of a rectangular frame, spaced parallel panels within said frame, and an illumination source between said panels.

7. An electrically illuminated outdoor sign resistant to high wind damage comprising:

a) a vertical support column having an upper end and a vertical axis;

b) an illuminated display having a secured position and a released position, a lower edge and a central vertical axis aligned with the central vertical axis of said column when said sign is in the secured position;

c) a lower horizontal arm with opposed first and second ends mounted on the upper end of said support column, said lower arm including a first sleeve attaching said lower arm to said column;

d) an upper horizontal arm with first and second ends attached to said display, said upper arm being parallel to said display lower edge and aligned with said lower support arm when said display is in the secured position, said upper arm including a second sleeve attaching said upper arm to said display;

e) a pivot mechanism joining said support arms adjacent said first ends;

f) a connection to a source of electricity extending to said illuminated display through said column, said pivot mechanism and said arms; and g) a retainer mechanism between the second ends of said support arms, said mechanism having a latched position releasibly securing the second ends of said support arms to each other when said sign is in the secured position, and an unlatched position, said retainer mechanism being moved to the unlatched position by a wind force greater than a predetermined value, allowing rotation of said display around said pivot mechanism to said released position.

8. The sign of claim 7, wherein said connection to a source of electricity includes an electric swivel mounted in said pivot mechanism, first wiring extending upwardly through said column and said lower arm to said swivel, and second wiring extending from said swivel through said upper arm to said display.

9. The sign of claim 7, wherein said pivot mechanism is comprised of a vertical shaft attached to said upper and lower arms, at least one of said arms being rotatable relative to said shaft.

10. The sign of claim 7, wherein the second end of one of said arms includes a recess, and said retention mechanism is comprised of a retractable retainer mounted in the other of said arms, said retainer being forced from said recess when wind force against said display exceed a predetermined value.

11. The sign of claim 10, wherein said retractable retainer is a spherical ball, said retention mechanism including a spring urging said ball into said recess.

12. The sign of claim 7, wherein said display is comprised of a rectangular frame, spaced parallel panels within said frame, and an illumination source between said panels.

13. An electrically illuminated outdoor sign resistant to high wind damage comprising:

a) a vertical support column having an upper end and a vertical axis;

b) an illuminated display having a secured position and a released position, a lower edge and a central vertical axis aligned with the central vertical axis of said column when said sign is in the secured position;

c) a lower horizontal arm with opposed first and second ends mounted on the upper end of said support column, said lower arm including a first sleeve attaching said lower arm to said column;

d) an upper horizontal arm with first and second ends attached to said display, said upper arm being parallel to said display lower edge and aligned with said lower support arm when said display is in the secured position, said upper arm including a second sleeve attaching said upper arm to said display;

e) a pivot mechanism joining said support arms adjacent said first ends, said pivot mechanism including a cylindrical vertical shaft attached to said upper and lower arms, at least one of said arms being pivotal about said shaft, and an electrical swivel mounted within said shaft;

f) first wiring extending upwardly through said column and said lower arm to said swivel, and second wiring extending from said swivel through said upper arm to said display; and g) a retainer mechanism between the second ends of said support arms, said mechanism having a latched position releasibly securing the second ends of said support arms to each other when said sign is in the secured position, and an unlatched position, said retainer mechanism being moved to the unlatched position by a wind force greater than a predetermined value, allowing rotation of said display around said pivot mechanism to said released position.

14. The sign of claim 13, wherein said pivot mechanism is comprised of a vertical shaft attached to said upper and lower arms, at least one of said arms being rotatable relative to said shaft.

15. The sign of claim 13, wherein the second end of one of said arms includes a recess, and said retention mechanism is comprised of a retractable retainer mounted in the other of said arms, said retainer being withdrawn from said recess when wind force against said display exceed a predetermined value.

16. The sign of claim 15, wherein said retractable retainer is a spherical ball, said retention mechanism including a spring urging said ball into said recess.

17. The sign of claim 13, wherein said display is comprised of a rectangular frame, spaced parallel panels within said frame, and an illumination source between said panels.

* * * * *